US010696536B2

(12) United States Patent
Nini

(10) Patent No.: US 10,696,536 B2
(45) Date of Patent: Jun. 30, 2020

(54) DELIVERING TAP WITH CAM-TYPE OPENING

(71) Applicant: Vitop Moulding S.R.L., Alessandria (IT)

(72) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 0 days.

(21) Appl. No.: 16/483,980

(22) PCT Filed: Jan. 12, 2018

(86) PCT No.: PCT/IT2018/000004
§ 371 (c)(1),
(2) Date: Aug. 6, 2019

(87) PCT Pub. No.: WO2018/150443
PCT Pub. Date: Aug. 23, 2018

(65) Prior Publication Data

US 2020/0095112 A1 Mar. 26, 2020

(30) Foreign Application Priority Data

Feb. 16, 2017 (IT) ..... 102017000017332

(51) Int. Cl.
*B67D 3/04* (2006.01)
*B65D 47/26* (2006.01)

(52) U.S. Cl.
CPC ..... *B67D 3/047* (2013.01); *B65D 47/26* (2013.01); *B67D 3/045* (2013.01)

(58) Field of Classification Search
CPC ..... B67D 3/047; B67D 3/045; B65D 47/26
USPC ..... 222/505, 519–521
See application file for complete search history.

(56) References Cited

U.S. PATENT DOCUMENTS 503,767 A * 8/1893 Merrick ..... B67D 3/047 137/323
2,769,582 A * 11/1956 Schlicksupp ..... B65D 47/242 222/513
2,851,202 A * 9/1958 Bradbury ..... B65D 47/061 222/505
3,062,496 A * 11/1962 Stehlin ..... F16K 3/28 251/218

(Continued)

*Primary Examiner* — Patrick M. Buechner
*Assistant Examiner* — Michael J. Melaragno
(74) *Attorney, Agent, or Firm* — Young Basile Hanlon & MacFarlane, P.C.

(57) ABSTRACT

A delivering tap for delivering liquids from a container includes a main body with a connecting element having fitting means with the container, and a supporting body adapted to be closed by a plug associated with a cam seal, the supporting body comprising a first opening for exiting liquid, and sealing means associated with the first opening and plug, the supporting body comprising external guiding means obtained on its external surface to guide the plug in the opening and closing of the plug cooperating with a cam profile, the plug comprising a central cylinder having lower sealing means obtained at its lower end and adapted to be coupled with the sealing means of the main body to determine the seal of the plug next to the first opening, the cam profile being made of two parts, the first part on the plug and the second part on the cam seal.

10 Claims, 18 Drawing Sheets

(56) References Cited

U.S. PATENT DOCUMENTS

| | | | | | |
|---|---|---|---|---|---|
| 4,619,377 | A * | 10/1986 | Roos | B67B 7/26 | 222/129 |
| 5,004,127 | A * | 4/1991 | Morel | B05B 11/0027 | 222/505 |
| 5,152,425 | A * | 10/1992 | Baudin | B05B 3/02 | 222/1 |
| 6,978,981 | B2 * | 12/2005 | Roos | B67D 3/045 | 251/265 |
| 7,681,764 | B2 * | 3/2010 | Nini | B67D 3/045 | 222/153.05 |
| 7,721,755 | B2 * | 5/2010 | Smith | F16K 3/246 | 137/384 |
| 8,387,837 | B2 * | 3/2013 | Bellmore | B67D 3/0058 | 222/505 |
| 8,640,931 | B2 * | 2/2014 | O'Keefe, Jr. | B67D 1/0004 | 222/501 |
| 8,870,039 | B2 * | 10/2014 | Bellmore | B67D 3/0058 | 222/505 |
| 2006/0261099 | A1 * | 11/2006 | Nini | B67D 3/047 | 222/519 |
| 2013/0306684 | A1 * | 11/2013 | Bellmore | B67D 3/043 | 222/505 |

* cited by examiner

DELIVERING TAP WITH CAM-TYPE OPENING

CROSS REFERENCE TO RELATED APPLICATION

The present application claims priority to Italian Patent App. No. 102017000017332, filed Feb. 16, 2017, incorporated herein in its entirety.

TECHNICAL FIELD

The present invention refers to a delivering tap of liquids from containers, in particular the so-called containers of the "Bag-In-Box" (BIB) type. In particular, the invention relates to a delivering tap completely made of plastic material, which can be adapted to connecting systems existing on the market, equipped with a system of the tamper evident type, which points out the occurred first opening of the tap, safeguarding the product contained inside the container from a possible counterfeiting.

Moreover, the inventive tap is equipped with a cam-type guiding system, which is obtained partly on an upper plug and partly on a sealing element, which is operatively assembled on the main body, as will be described below in more detail.

This system with split cam made of two profiles obtained on two different parts, which compose the inventive tap, allows obtaining a part which is geometrically simpler and with a lower number of pieces, as will be explained in more detail below.

Moreover, the inventive tap is equipped with an internal elastic valve, which performs an operating seal on the main sealing cylinder of the plug with two flexible lips (upper plug seal).

The lower seal (seal on the liquid exit hole) is performed due to the operating coupling between the main cylinder of the plug and the tap body, which can have different geometric shapes, but always fall within the scope of the invention, as will be described in more detail below.

A feature of the present invention is providing a tap which is completely made of plastic material (therefore easily recyclable) and which can be adapted to the connectors present on the market and with an integrated anti-counterfeiting (tamper evident) system, adapted to replace a known tap version currently marketed by companies such as ITW Illinois Tool Works Inc., shown for example in FIG. 16, or such as company Scholle, as shown in FIG. 15.

BACKGROUND

Various tap configurations are known in the art, produced by ITW Illinois Tool Works, Inc. or Sholle companies, which are known embodiments of this product, for example disclosed in documents AU-A-656111 and WO-A-2011008829.

Such known taps however have some defects. For example, none of the marketed taps is equipped with an integrated tamper evident warranty seal, and therefore it is necessary to add an aluminum operculum to guarantee as authentic the product contained in the BIB container and above all the evidence of a performed opening of the container.

There are no anti-counterfeiting or removal preventing elements between tap and container mouth, so that, in known taps, it is possible to easily remove the plug from its seat to be able to fill the container with counterfeited liquid.

All taps on the market use opening systems through torsion (not with an automatic closure) of the plug which follow a cam profile; such profile is usually obtained on the main body of the tap, while its teeth, which are guided during the opening step, are obtained on the plug, inside it, making the mold and the plastic piece complex (which, during the assembling step, then needs an additional plastic piece to be able to cover the necessary holes to obtain inside the plug the two teeth which are guided by the cam profile present on the body).

As stated above, therefore, in the prior art such cam profiles are obtained with systems which make the injection molds complex, together with the tap assembling, thereby increasing their costs.

In previously manufactured taps, there are droplet-holding systems (after the delivery) which are scarcely efficient and strongly increase the complexity of the die, in addition not to solve the problem caused by the droplet present after the delivery, at the end of the closing step of the tap, which can fall on the ground, being uncomfortable for the end user.

Known taps allow a maximum flow of liquid which reaches a limit which cannot be exceeded by the prior art, which can instead be exceeded, due to structural geometric arrangements, with the tap of the invention.

In known versions of taps with cam-type opening (to unscrew them) placed with their delivery chamber in a vertical position, there is always an upper seal on the unscrewing plug and a lower seal on the liquid exit hole. In the prior art, sometimes the upper seal is not perfect, as well as the lower seal.

In the tap of the invention, due to the insertion in the system of an element with flexible lips, a perfect upper seal is always obtained, and the lower seal is performed due to special geometries, which improve the technologies of known taps.

The inventive tap, due to the splitting of the cam system into two parts, allows simplifying both the geometry of the plastic pieces forming the tap itself, and the assembling cycle, making drastically decrease the final cost of the tap itself.

The tap of the present invention provides a reversal of the concept applied so far in prior art taps, namely the inventive tap has teeth on the body, which teeth usually were obtained inside the plug, while now, due to the splitting of the cam profile (half on the seal and half on the plug) the guiding geometry of the teeth present on the body is made on the plug); this solution allows doing without an additional piece to cover the geometries necessary to obtain the teeth in the taps obtained according to the prior art, since the particular plug exits its assembling step finished and ready to be assembled, decreasing the final production cost of the plug with respect to the prior art.

SUMMARY

Therefore, object of the present invention is solving the above prior art problems, by providing a delivering tap made of plastic material, which is simple and eco-compatible and can be adapted to connectors present on the market, not requiring their modification and changing the actuation system, making it unique and universal for all marketed connectors. The known connectors 6, 7 and 8, shown in FIGS. 12, 13 and 14 from company ITW are three, and the inventive tap is capable of adapting thereto without problems with a single solution.

The connector 6, 7, 8 must be able to be fastened, preferably by means of a pair of undercut geometries 3.10 present on the main body or supporting body of the tap 3 of the invention, on a seat 6.1, 7.1 and 8.1 present on the connectors 6, 7 and 8 and provide a seal onto the external walls 3.20 of the new plug.

The present invention, moreover, solves the above prior art problems by providing an improved delivering tap which is made of a minimum number of parts, is equipped with a double (upper and lower) internal sealing system, which is the main member of the tap, and which allows performing both closing and opening operations of the tap, and a greater oxygen-seal, also due to the use of plastic materials with high seal, in addition to preventing or decreasing the liquid oxidation inside, since the inventive tap, with respect to known taps, strongly decreases the amount of air entered into the BIB container due to its special shapes.

A further object of the present invention is providing a tap which performs a better seal with respect to the one of known taps, thereby obtaining a strong increase of the oxygen barrier. The improvement of the oxygen barrier is further obtained due to the fact that the closure is directly performed on the liquid exit hole (lower seal) of the body, removing leakages due to various parts exposed towards outside and the second seal (upper seal) is made due to a valve with double lip.

The inventive tap, being provided with a high oxygen barrier, is suitable for aseptic applications, and therefore for aseptic treatments, which sometimes result damaging and therefore cannot be applied to some types of known taps, since their dispenser must be subjected to sterilizing cycles with hot steam, or gamma rays, or distilled water or other agents (even mutually associated), which in some cases are aggressive, impairing the closure operation.

The geometry with disk (with or without discriminant) with which the body is equipped, immediately orients the tap in the correct position, strongly helping container manufacturing companies, above all of the bag type, which manage to assemble the tap on the mouth immediately in the right position.

The inventive tap is equipped on its back with an anti-counterfeiting device, which will be coupled with a similar geometry present on the connecting mouth (not shown) in order to make the inventive tap unmovable once having inserted it into the mouth (after filling the container).

The above and other objects and advantages of the invention, as will result from the following description, are obtained with a delivering tap as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention as appears from the enclosed claims.

The present invention will be better described by some preferred embodiments thereof, provided as a non-limiting example, with reference to the enclosed drawings, in which:

DETAILED DESCRIPTION

Figure 1:
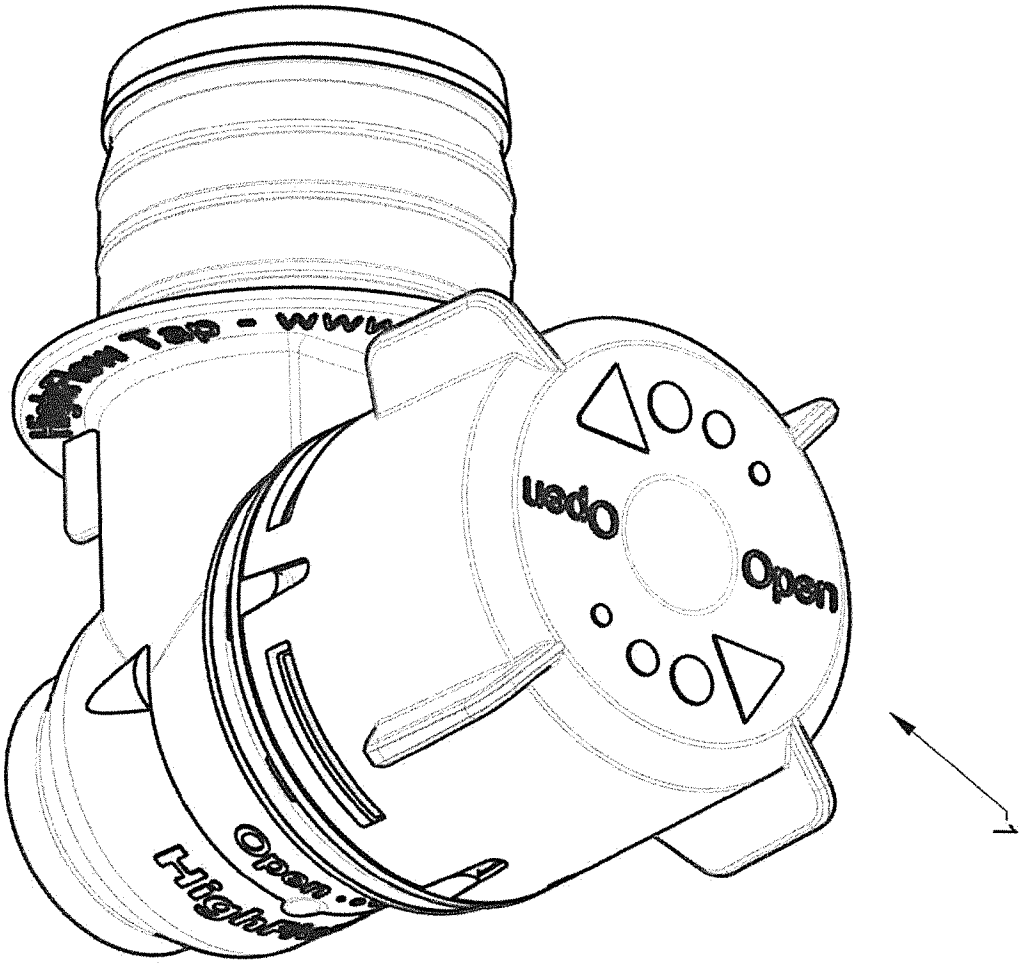
FIG. 1 is a perspective view of an embodiment of the tap according to the present invention.
Figure 2:
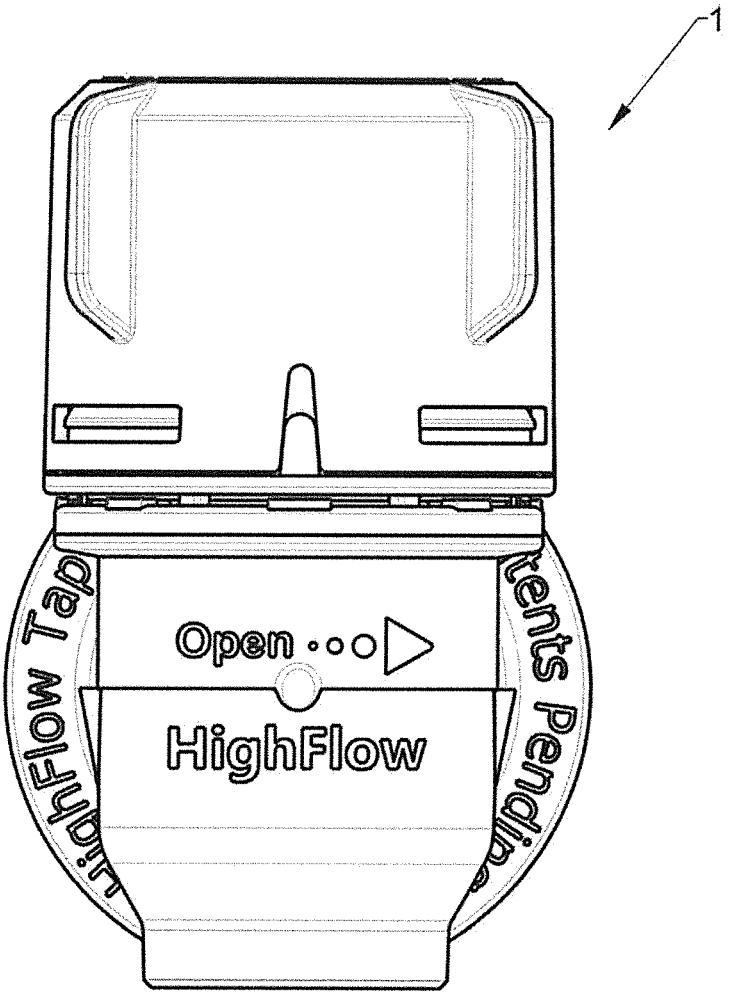
FIG. 2 is a front view of an embodiment of the tap according to the present invention.

With reference to the Figures, an example and non-limiting embodiment of the delivering tap 1 of the present invention is shown and described. It will be clear for a skilled person in the art that the described tap can be made of equivalent shapes, sizes and parts, and can be used for various types of containers, for example the so-called "Bag-In-Box" ones, but also the rigid or semi-rigid containers, or others.

The delivering tap or tap 1 of the invention, preferably completely made of plastic material, is used for delivering liquids from a container (not shown), and comprises: a main body 3 comprising a connecting element 3.20 to the container, comprising fitting means 3.1 with the container, and a supporting body 3.21 adapted to be closed by a plug or upper closing element 2 coupled with a valve 5, preferably an internal valve 5 with flexible lips; such supporting body 3.21 comprises a first opening 3.2 for exiting liquid, and sealing means 3.3 associated with the first opening 3.2 and adapted to be operatively coupled with lower sealing means 2.1 of the plug 2.

Preferably, the fitting means 3.1 are composed of sealing rings 3.4 obtained on the connecting element 3.20, adapted to be operatively connected to the connecting mouth (not shown in the figures) which is in turn welded to the BIB container, and operates as connecting element between the tap 1 and the BIB container. In a preferred way, the connecting element 3.20 of the main body 3 comprises a ring 3.5 with sharp edge, which operates as removal-preventing abutment and consequently as anti-counterfeiting of the tap once inserted in the connecting mouth. Preferably, the supporting body 3.21 comprises a seat 3.6 made therein, adapted to operate as guide/seat and removal-preventing abutment of the internal valve 5 with flexible lips, and external guiding means 3.7, obtained on its external surface and useful to guide the plug 2 in the opening and closing steps of the plug, by cooperating with a cam profile made of two parts: the first part 2.6, preferably the upper part, of the cam profile being made on the plug 2 and the second part 4.2, preferably the lower part, of the cam profile being made on a cam seal 4 associated with the plug 2, preferably with its upper part 2.7 of the plug 2.

Figure 12:
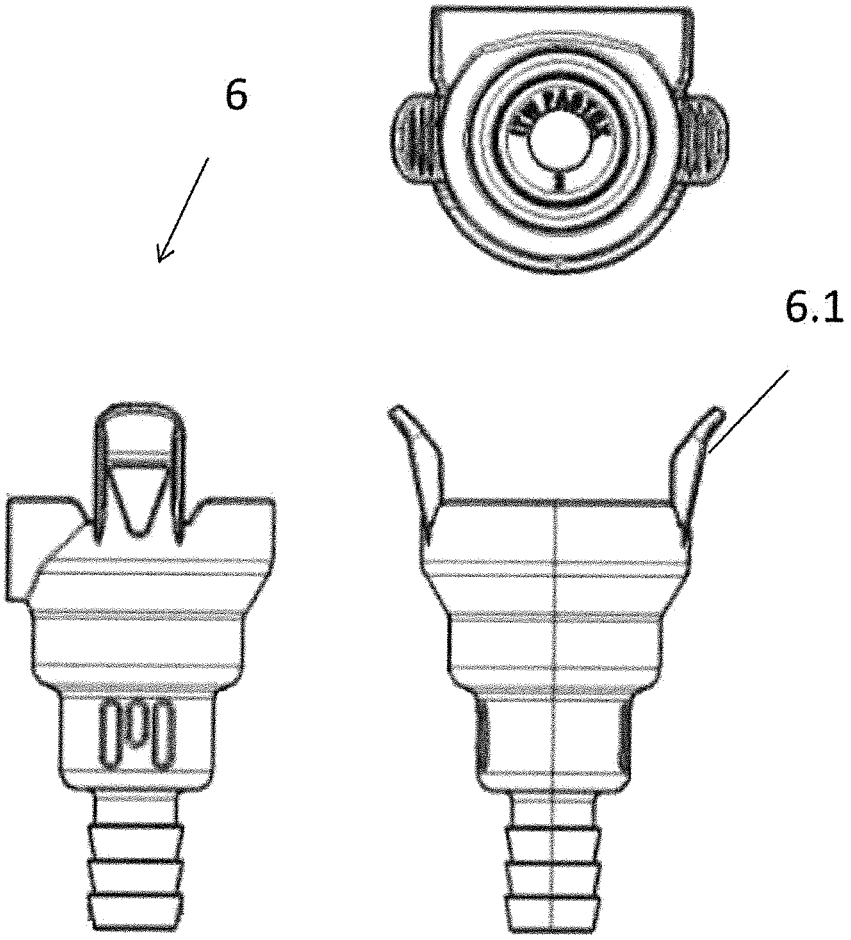
FIG. 12 (Prior Art)
FIG. 12 is a front, side and bottom view of a first connector for containers according to the prior art.
Figure 13:
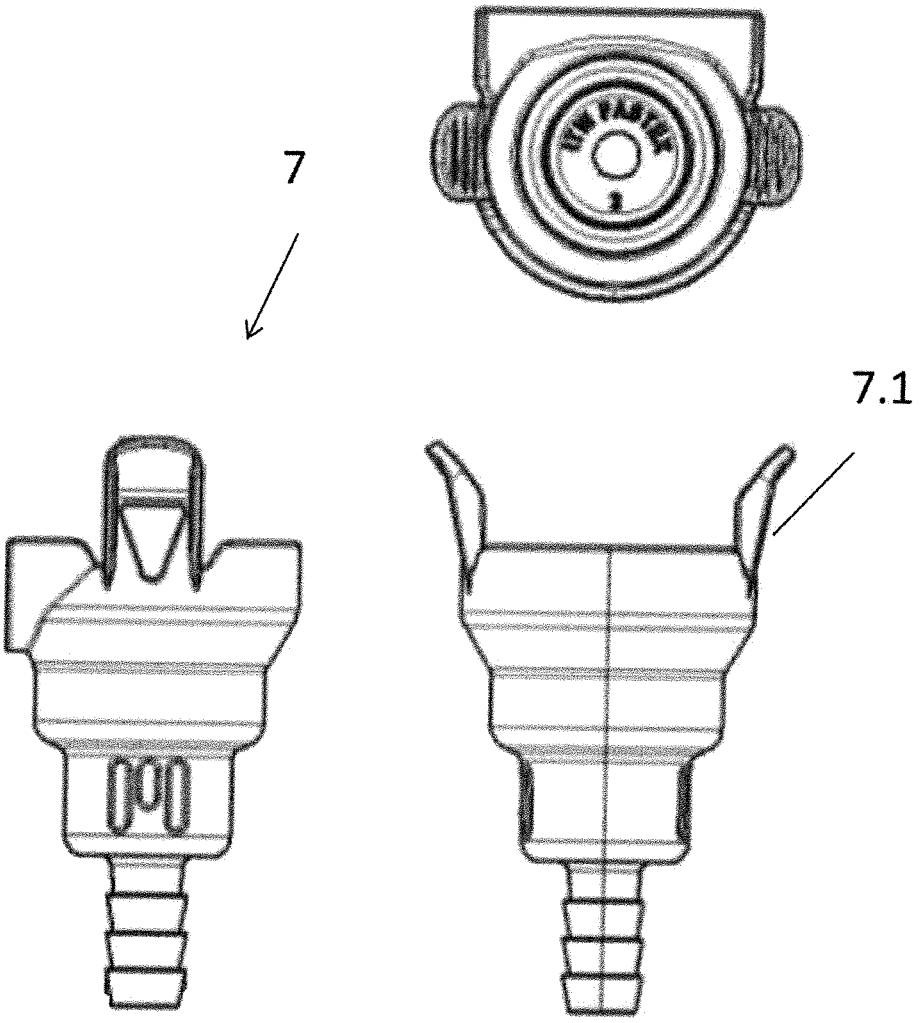
FIG. 13 (Prior Art)
FIG. 13 is a front, side and bottom view of a second connector for containers according to the prior art.
Figure 14:
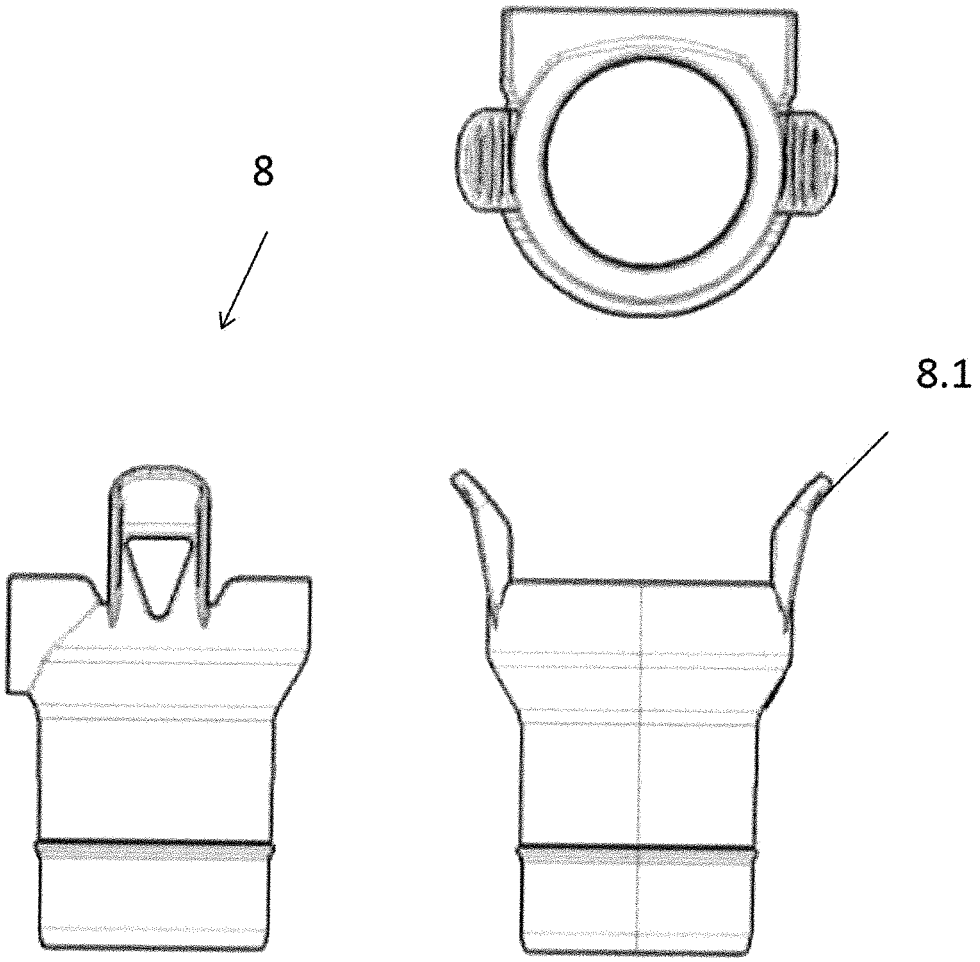
FIG. 14 (Prior Art)
FIG. 14 is a front, side and bottom view of a third connector for containers according to the prior art.

Preferably, the main body 3 comprises a complete disk 3.8, made on the external surface of the connecting element 3.20 and tap-orienting elements 3.9, for example two elements 3.9, obtained on the supporting body 3.21 and comprising through-windows 3.9 which form an holding edge of the seat 3.6, preferably obtained when molding through direct coupling of the mold male parts. Preferably, the main body 3 comprises fastening element 3.10 obtained on the external surface of the supporting body 3.21, preferably two standard fastening elements of the three connectors on the market, shown in FIGS. 12, 13 and 14 and manufactured by company ITW.

Preferably, the main body 3 also comprises fastening elements 3.11 of the seal 4 obtained on the external surface of the supporting body 3.21, connected to abutment ribs 3.12 and to abutment elements 3.13 of the seal 4, useful when assembling the plug 2 on the cam seal 4 (pre-assembled on the main body 3); the plug 2 comprising the first part 2.6 of the cam profile made inside the upper part 2.7 of the plug, is associated with the cam seal 4 preferably by means of projecting elements 4.1 present on the cam seal 4, which cooperate with seats 2.2 present on the plug 2, in particular made inside the upper part 2.7, by being inserted therein.

The plug 2 comprises a central cylinder 2.3 connected to the upper part 2.7 of the plug and comprising the lower sealing means 2.1 obtained at its lower end, adapted to be coupled with the sealing means 3.3 of the main body 3, preferably composed of a flexible profile 3.3 of the first opening 3.2, to determine the (lower) seal of the plug next to the first opening 3.2, when the tap will not be operating. The plug 2 comprises upper sealing means 2.4, preferably composed of an area of the central cylinder 2.3 with increased diameter adapted to be operatively coupled with two lips 5.1 and 5.2 of the valve 5, and creates the upper seal of the tap 1.

Preferably, the plug 2 comprises external gripping means 2.5 obtained on the external surface of the upper part 2.7 to facilitate the rotation/opening of the plug 2 of the tap 1 once assembled with all the components. In a preferred way, the plug 2 comprises a threading made therein, preferably two threads made at 180° one to the other, which operates as upper abutment of the external guiding means, for example composed of a tooth 3.7, of the main body 3, and makes the edge of the first (upper) part 2.6 of the cam profile. In practice, the cam profile adapted to guide the plug 2 to its opening position (guided by the tooth 3.7) is split into two parts: the first part 2.6 is inside the plug 2 and the second part 4.2 is in the cam seal 4. Advantageously, this splitting of the cam into two parts allows simplifying the parts, lowering their production costs, and facilitates the assembling of the tap.

Figure 15:
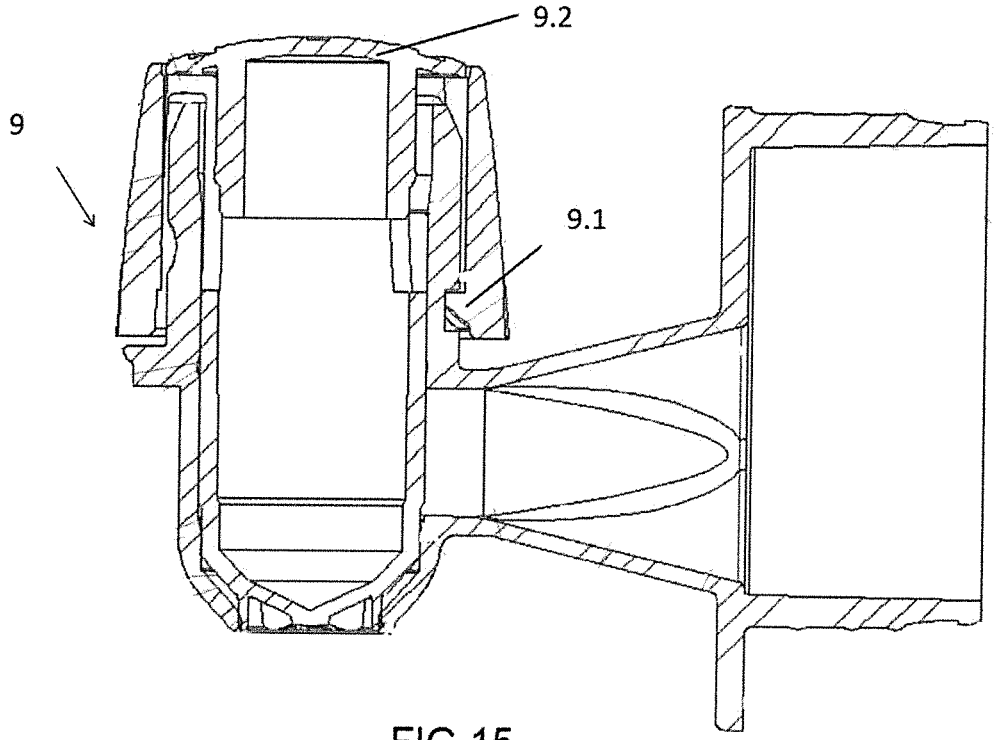
FIG.15 (Prior Art)
FIG. 15 is a sectional view of a first tap according to the prior art.
Figure 16:
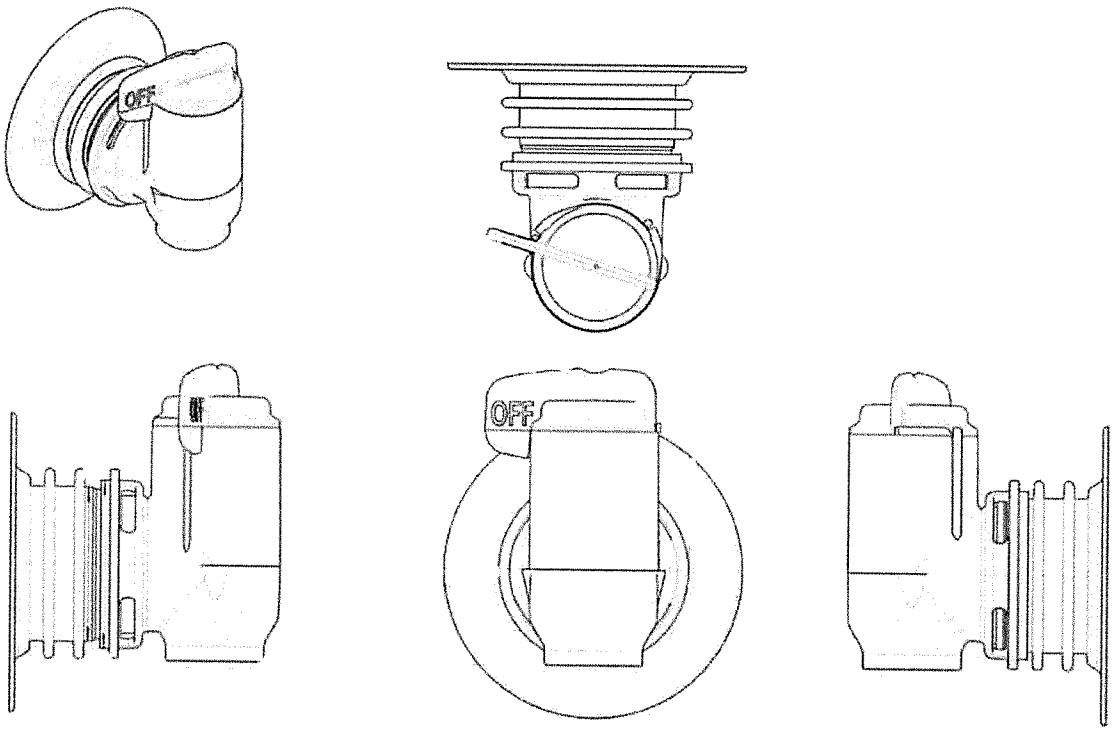
FIG.16 (Prior Art)
FIG. 16 is an isometric, top, right side, front and left side view of a second tap according to the prior art.
Figure 17:
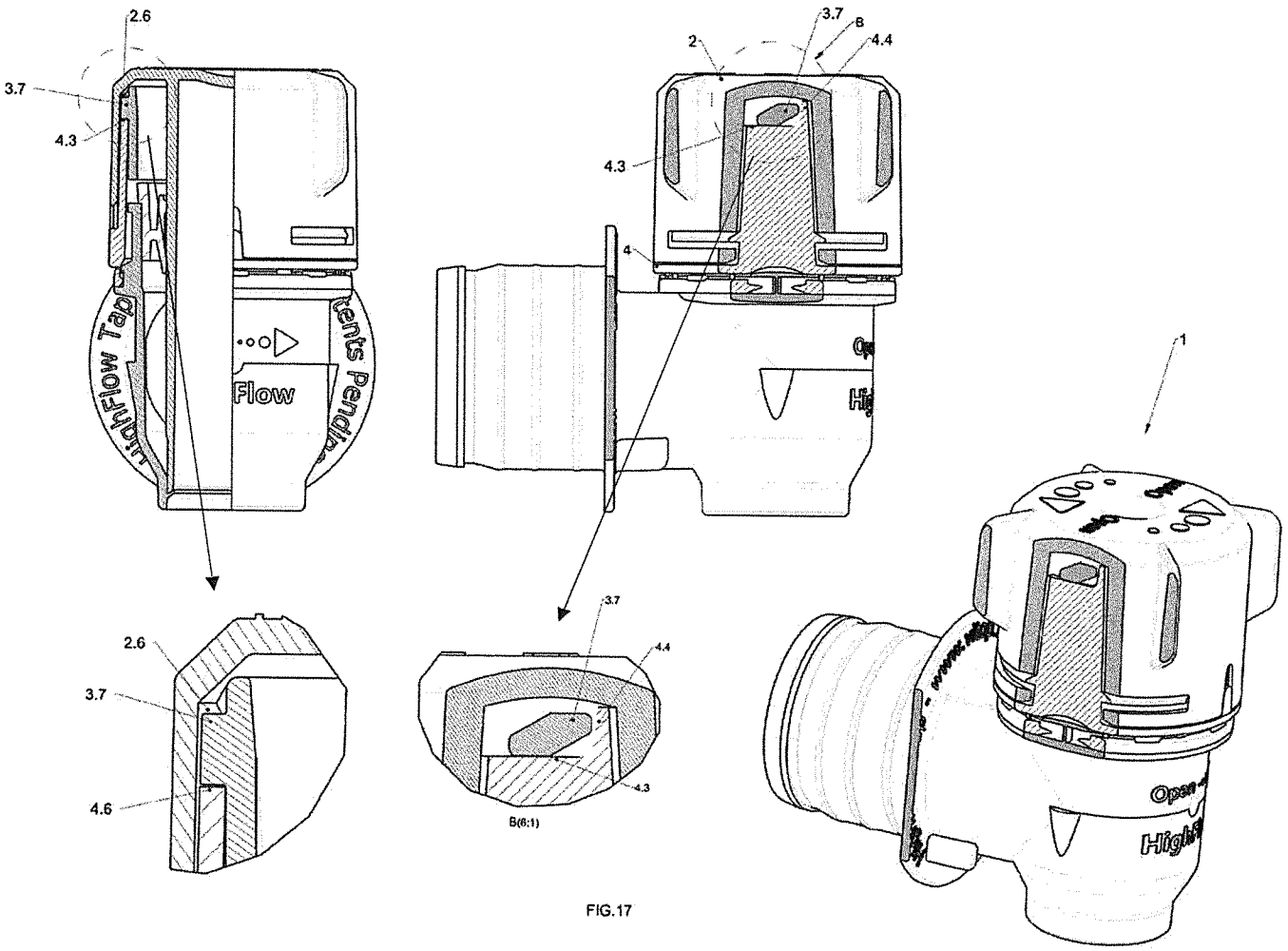
FIG. 17 is an isometric, side sectional and detailed view of an embodiment of the tap according to the present invention.
Figure 18:
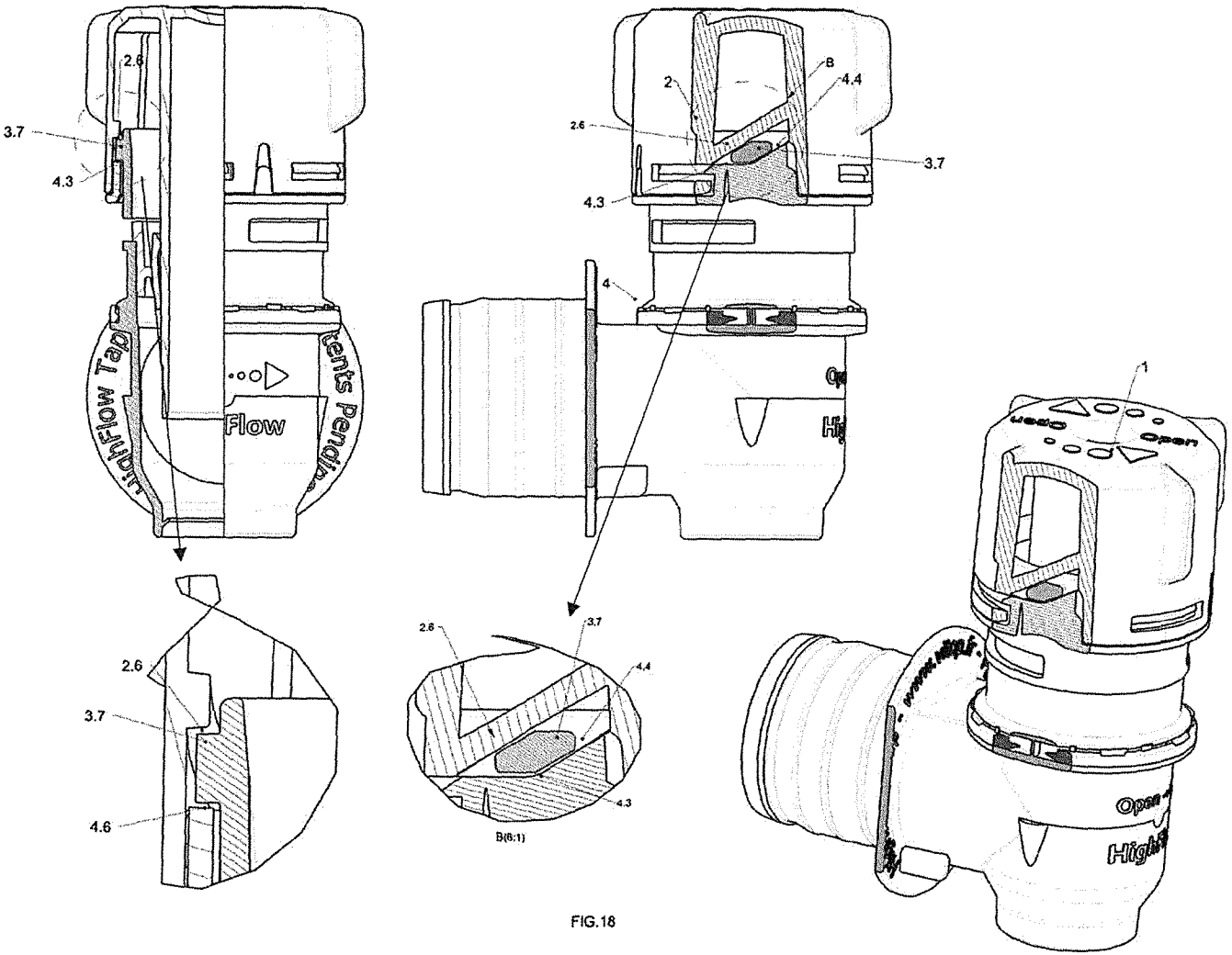
FIG. 18 is an isometric, side sectional and detailed view of an embodiment of the tap according to the present invention in its opening position.

Normally, in the cam profiles which guide the openings of plugs in rotation of a known type (such as those of company Scholle, for example) the cam profiles are obtained on the main body while the teeth (for example, the tooth 3.7) are obtained inside the plugs, which are the mobile part of the known plugs. This compels to product particular geometries of known plugs (in the example shown in FIG. 15, part 9.1) which need a further molded component adapted to cover the holes and the necessary geometries for the embodiment of internal teeth in the plug, and thereby generate an increase of the final price of the plug and more pollution due to the production cycle; the only task of this component is covering the plug holes necessary to product the internal teeth 9.1 which cannot be left opened, since they are a possible seat for dust and dirt. Advantageously, the splitting of the cam having the first part 2.6 inside the plug 2 and the second part 4.2 in the cam seal 4, for the tap 1 of the invention removes the need of producing a plug 2 with plug opening holes, since only the first part of the cam 2.6 has been obtained inside the plug, and therefore it is not necessary to produce and add a further dust-preventing covering part, such as for example necessary in the plug of company Scholle (FIG. 15).

The plug 2 of the tap 1 of the invention goes out of the mold with the upper part 2.7 already closed and therefore does not allow the dust and the dirt to reach inside of the plug. On the plug 2 there are weight-reducing recesses 2.8 useful to make more flexible the edges comprising the seats 2.2, composed for example by open slits 2.2, in order to flex them during the assembling step of the plug 2 on the cam seal 4; the elastic sealing valve 5 associated with the plug 2 preferably comprises, obtained on its external surface, fastening means 5.3 to the seat 3.6 of the main body 3, composed for example of a fastening step 5.3 to the holding edge of the seat 3.6, and an external cylindrical sealing surface 5.4 on an internal surface 3.14 of the supporting body 3.21, the internal surface 3.14 being adapted to be operatively connected to the valve 5 through interference.

The valve 5 further comprises the two flexible upper sealing lip 5.1 and lower sealing lip 5.2 adapted to be operatively coupled with the upper sealing means 2.4 of the plug 2, and a facilitating edge 5.6 to enable assembling the valve 5 on the main body 3 and plan seats 5.5 useful to provide an assembling thrust on a plane; a cam seal 4 (preferably of the tamper evident type) comprising the second (lower) part of the cam profile 4.2 made preferably on an external wall thereof, for example on the upper edge of a cylindrical wall, which allows the plug 2, once assembled on the tamper evident seal 4, to be guided by the external guiding means 3.7, preferably composed of the teeth 3.7 present on the main body 3 and is the lower abutment for the tooth 3.7 (the upper abutment of the tooth 3.7 is composed of the first (upper) part of the cam profile 2.6, preferably of the two threads at 180° obtained inside the plug 2).

Figure 3:
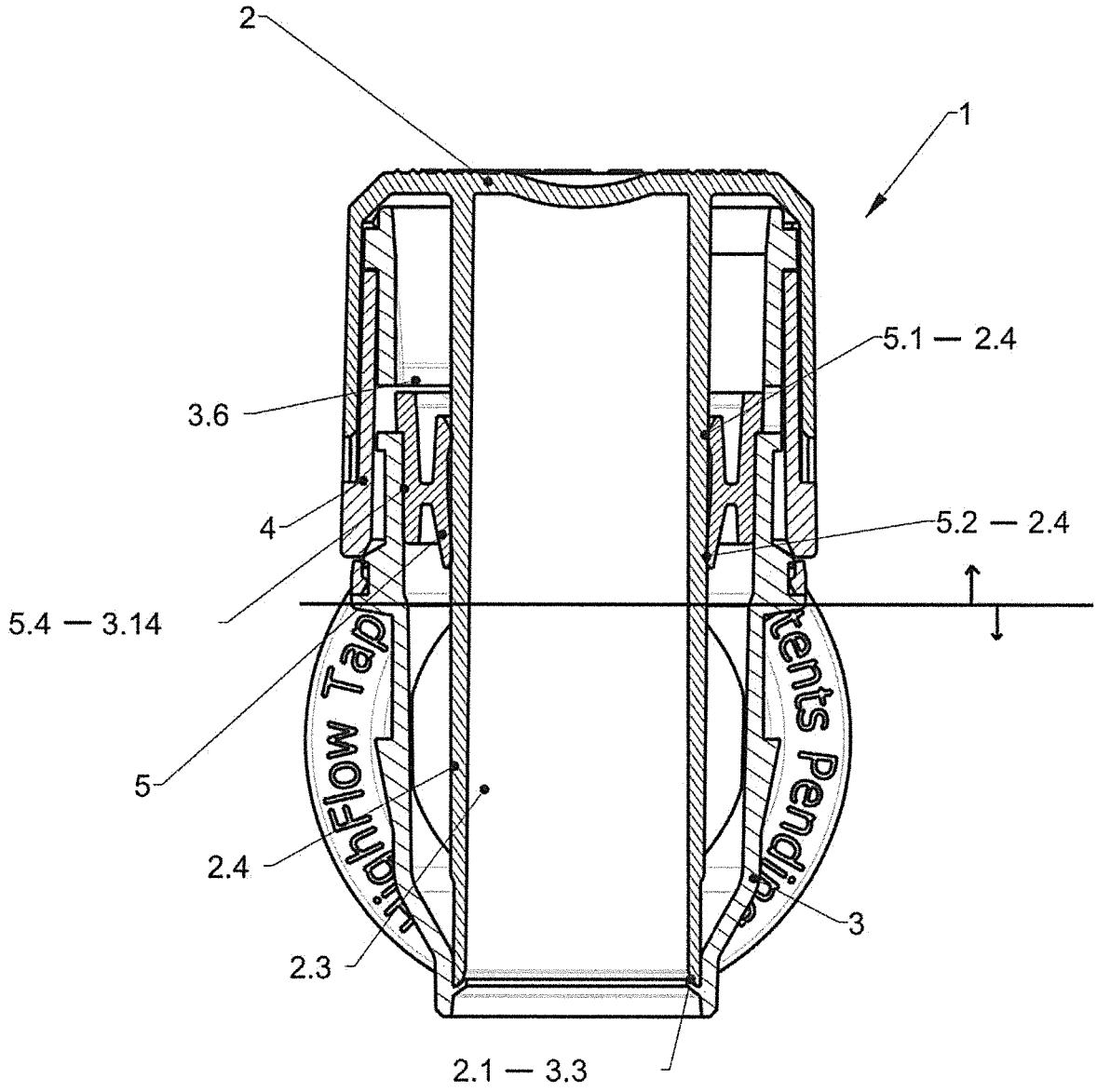
FIG. 3 is a front sectional view of an embodiment of the assembled tap according to the present invention.
Figure 4:
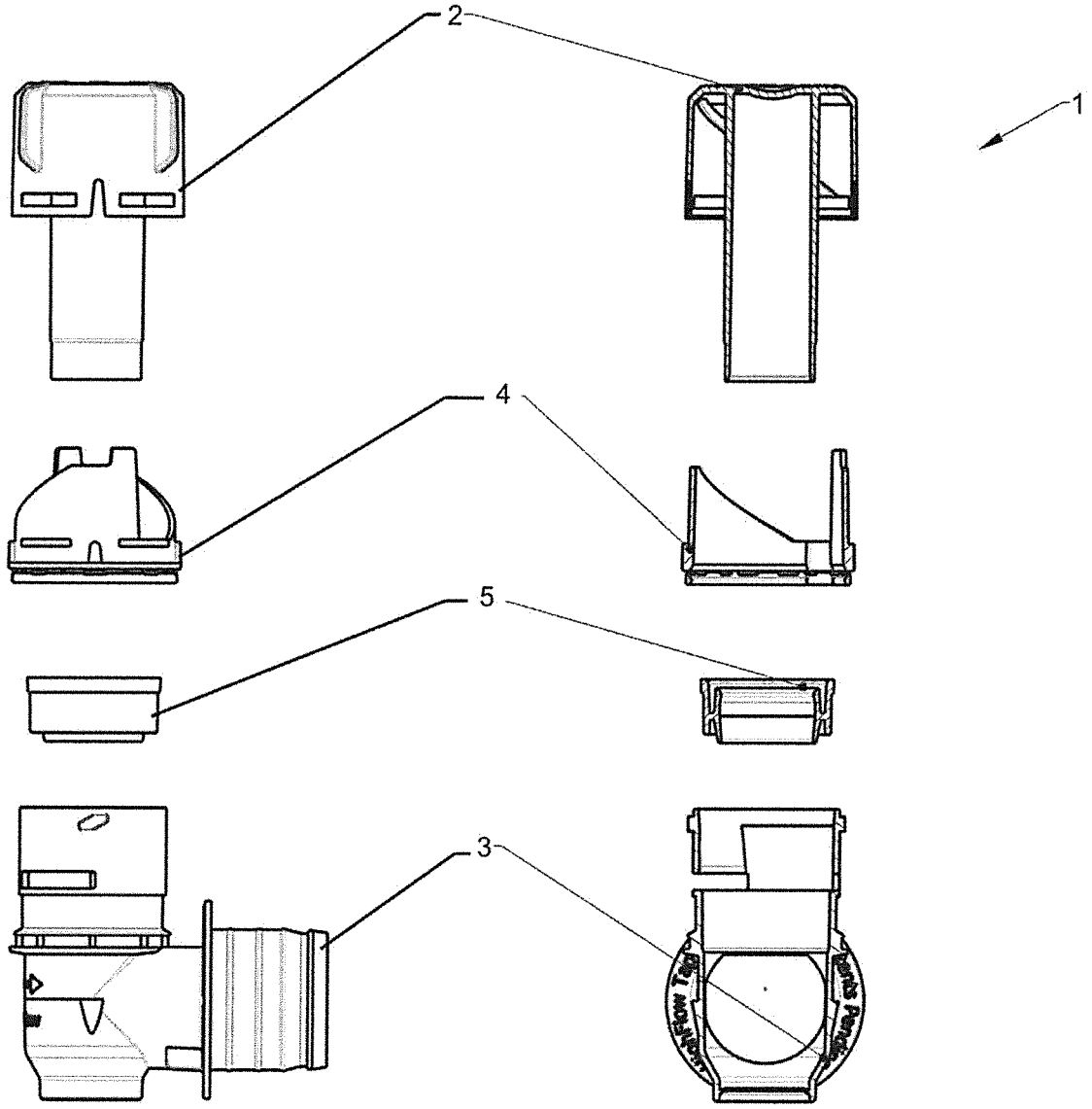
FIG. 4 is a front view and a side sectional exploded view of an embodiment of the tap according to the present invention.
Figure 5:
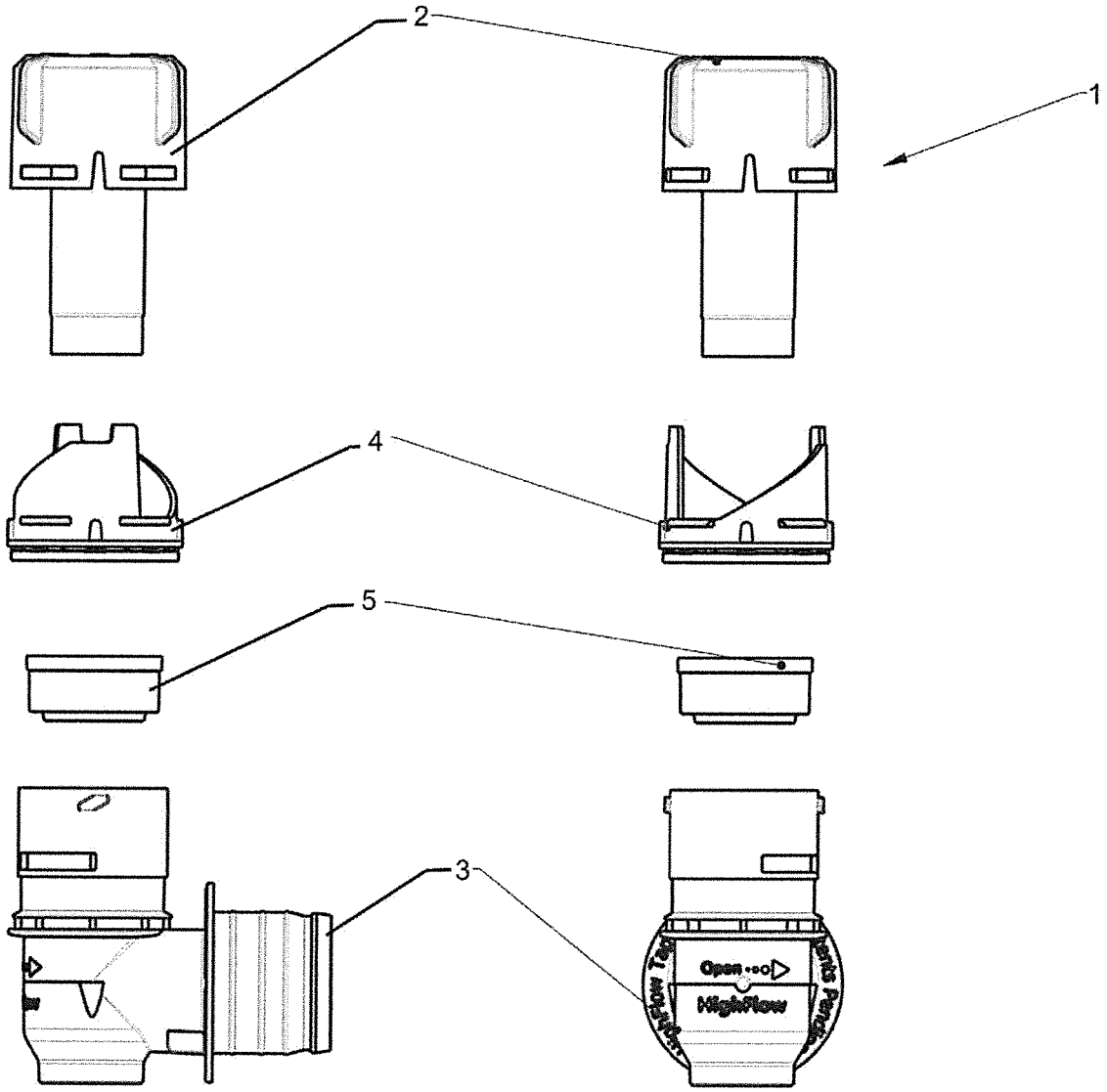
FIG. 5 is a front view and a side exploded view of an embodiment of the tap according to the present invention.
Figure 6:
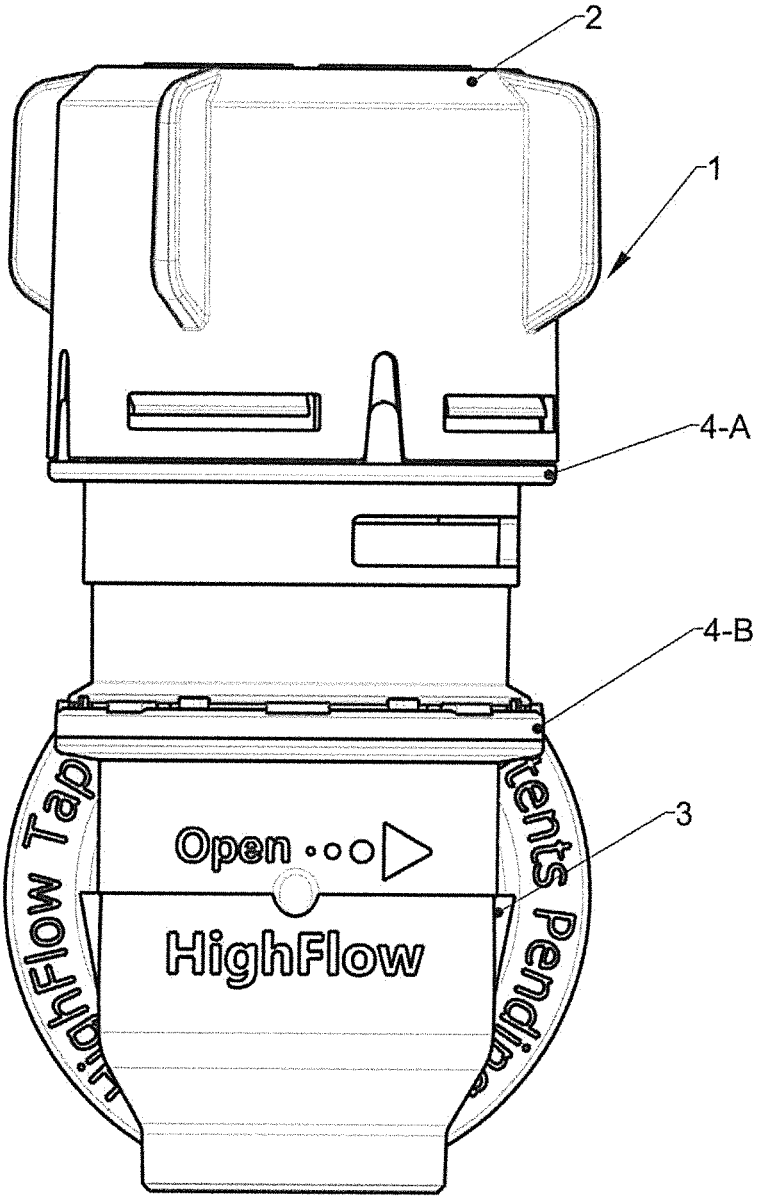
FIG. 6 is a front view of an embodiment of the tap according to the present invention in its opening position.

Moreover, the cam seal 4 comprises a plane profile 4.3 at the end of the second part 4.2 of the cam profile, on which the tooth 3.7 resides during the closing step (see FIG. 3) adapted to prevent the accidental opening of the plug 2 and a bearing 4.4 of the tooth 3.7 which limits its excursion during the closing step of the plug (FIG. 3). In a preferred way, the cam seal 4 comprises the projecting elements 4.1 obtained on its external surface, preferably four, useful to be fastened to the seats 2.2 of the plug 2 and abutments 4.8 useful to transmit the rotary motion of the plug 2 to the cam seal 4 once assembled.

The cam seal 4 further comprises a tamper evident ring 4.5 adapted to be separated from the cam seal 4 upon its first opening providing evidence thereof, preferably connected to the cam seal 4 through frangible elements 4.7 adapted to be broken upon the first opening; the cam seal 4 comprises abutment elements 4.10 adapted to transmit, when assembling, the insertion force to the ring 4.5, allowing it to pass the fastening elements 3.11 present on the main body 3 without damages and remaining untouched. The cam seal 4 preferably comprises two recesses 4.9 obtained on its internal surface at 180° one to the other, which allow the seal 4 to pass the teeth 3.7 of the main body 3 when assembling.

In particular, with reference to FIG. 3, the tap 1 is shown in section in its closing position, and it is noted that the plug 2 is inserted into the supporting body 3.21 of the main body 3. The central cylinder 2.3 is operatively sealing coupled (lower seal) on the geometry present on the first liquid outlet opening 3.2 by means of the lower sealing means 2.1 present on the central cylinder 2.3 of the plug 2. Internally to the tap 1, the valve 5 with the flexible lips 5.1 and 5.2 is assembled, and remains fastened to the main body 3 by means of undercuts obtained on the seat 3.6 (preferably two) obtained on the main body 3; the valve 5 is operatively externally sealing coupled through interference of the external cylindrical surface 5.4 on the internal surface 3.14 of the supporting body 3.2, and with operative seal (both static, but above all dynamic when opening the plug) with the coupled flexible lips 5.1 and 5.2 with the upper sealing means 2.4 of the plug 2 (upper seal), for example with the area of the central cylinder 2.3 with increased diameter. Previously, the cam-type tamper evident seal 4 inserted in the main body 3, in particular in the supporting body 3.21, has been assembled due to the recesses 4.9 which allow passing the teeth 3.7 of the main body 3 to form, once having assembled the plug 2, the complete cam formed of the first part (upper part) of the cam profile 2.6 and of the second part (lower part) of the cam profile 4.2 which guide the plug 2 during the opening torsion at the plug opening height.

Figure 7:
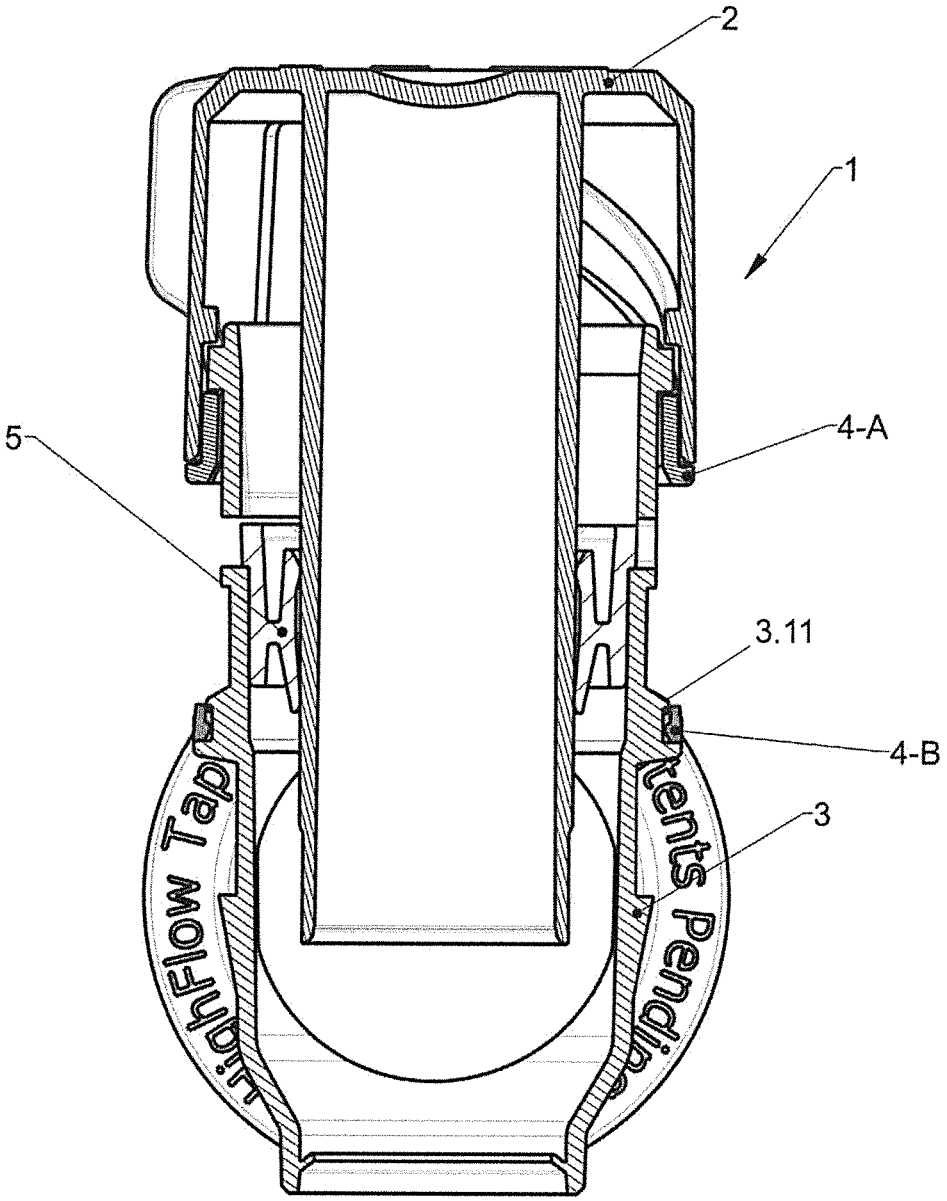
FIG. 7 is a front sectional view of an embodiment of the tap according to the present invention in its opening position.
Figure 8:
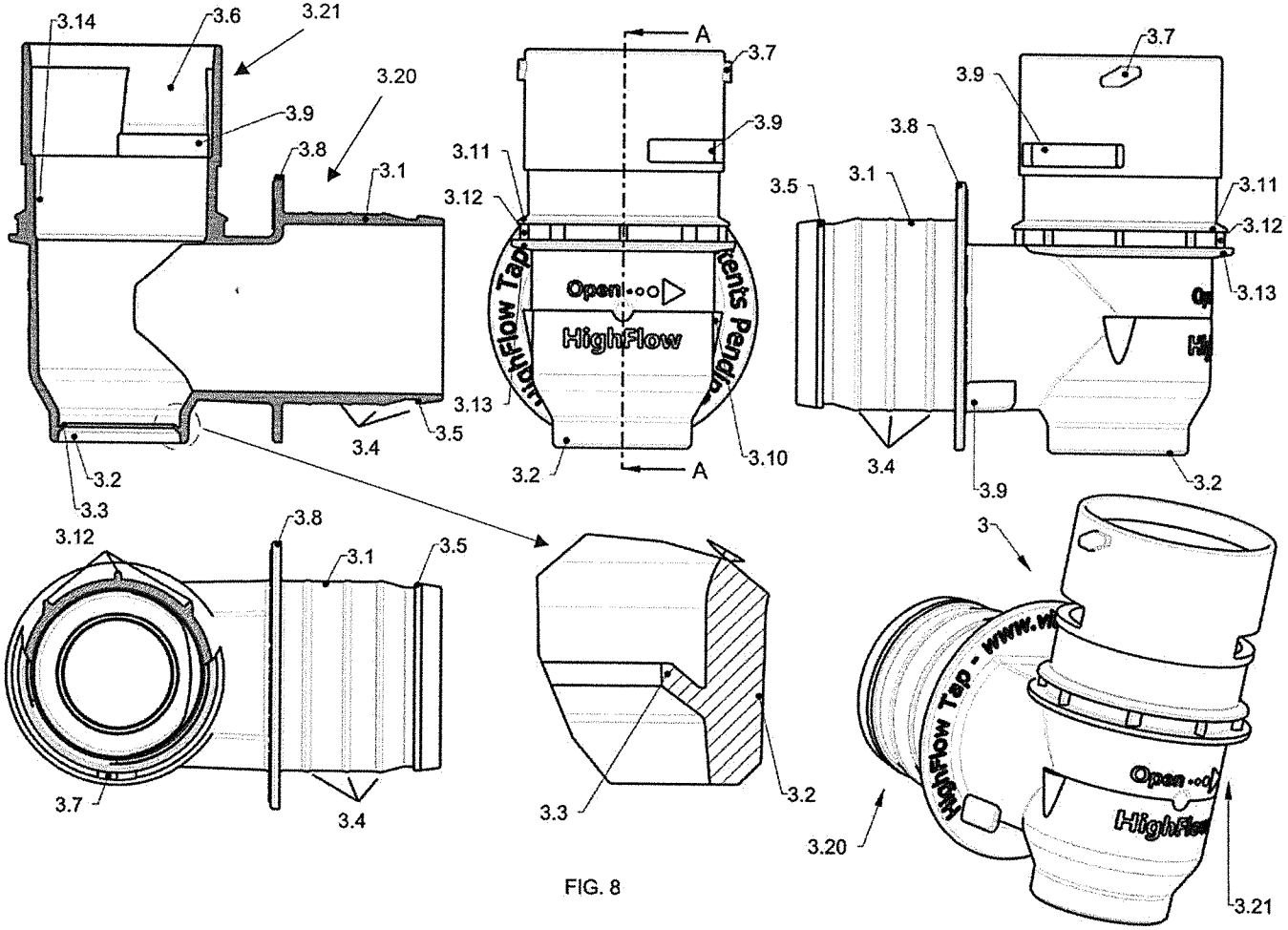
FIG. 8 is a front, side sectional, side, tope and isometric view of a component of the tap according to the present invention.
Figure 9:
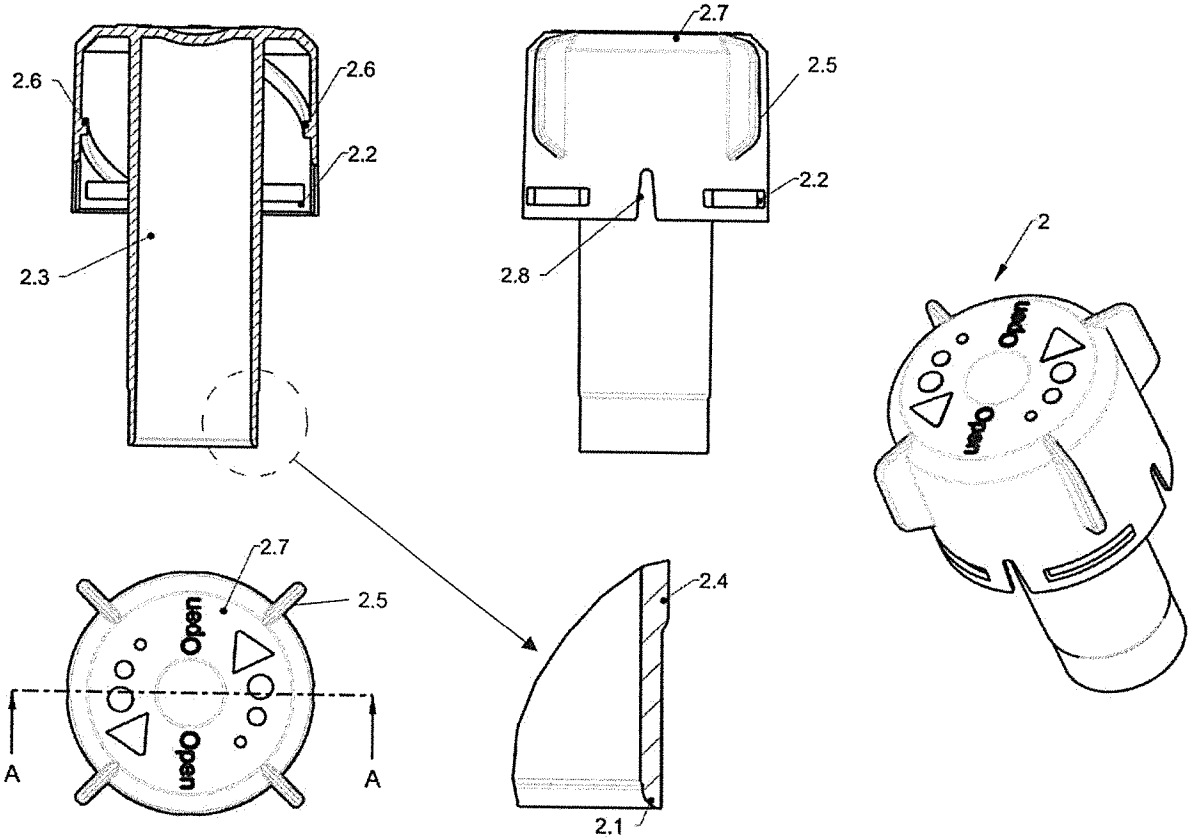
FIG. 9 is a front, side, top and isometric view of a component of the tap according to the present invention.
Figure 10:
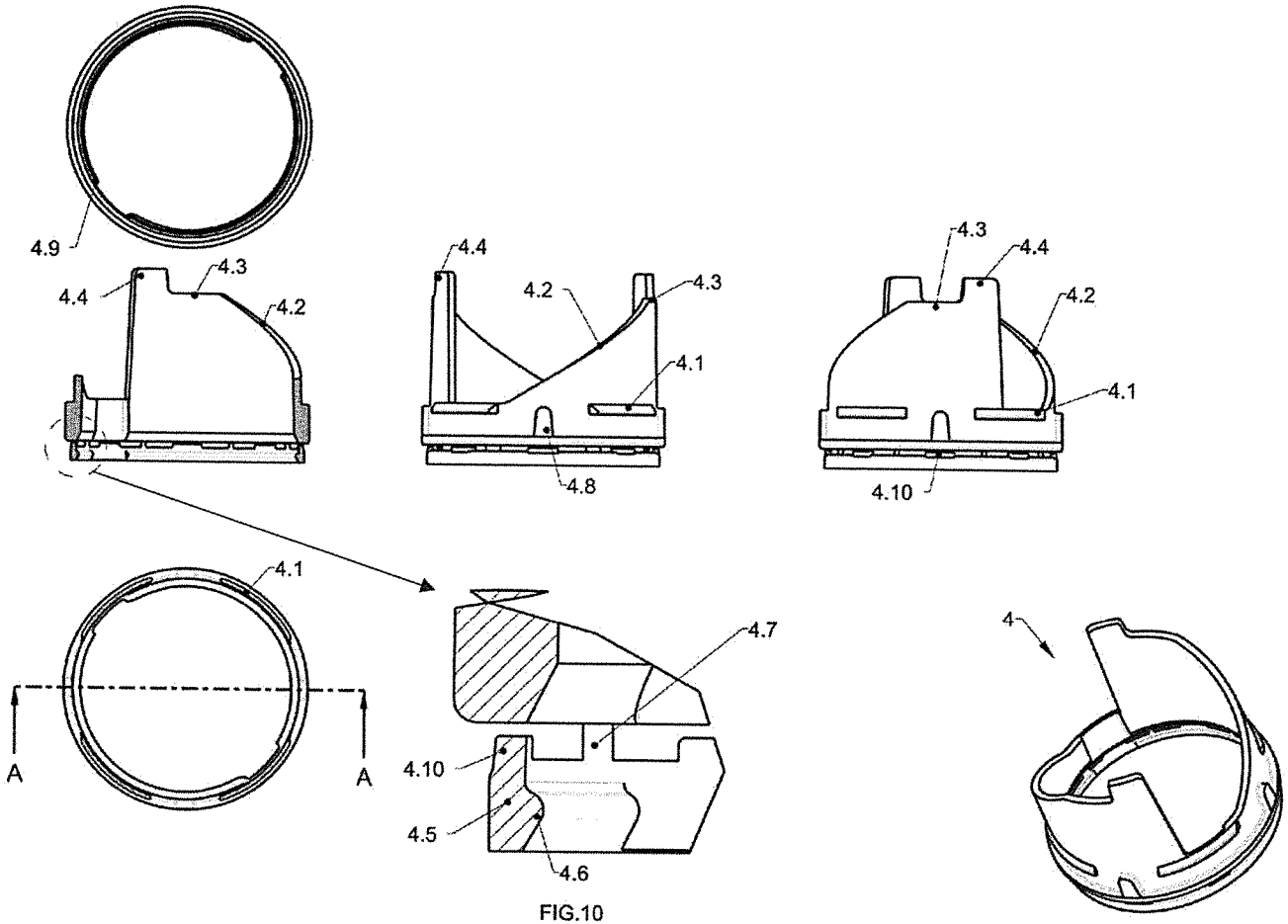
FIG. 10 is a front, side sectional, side, top and isometric view of a component of the tap according to the present invention.
Figure 11:
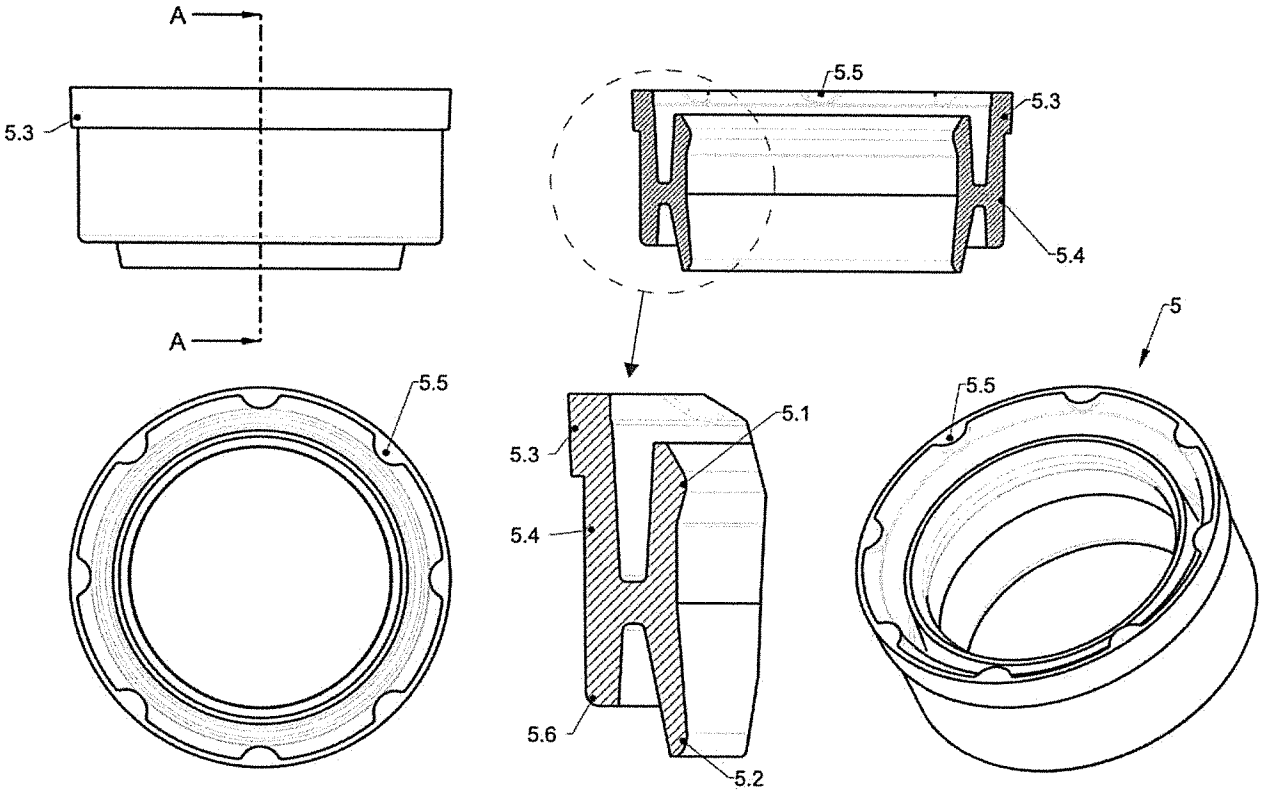
FIG. 11 is a front, side sectional side, top and isometric view of a component of the tap according to the present invention.

With reference to FIG. 7, the tap 1 of the invention is shown in its opening position. It can be noted that, once assembled, the plug 2 and the cam-type tamper evident seal 4 form a single body which cannot be divided. Once having ended the first opening, to give evidence thereof, the cam seal 4 is divided into two parts, part 4A with the upper part of the cam seal 4 which remains fastened to the plug 2, and part 4B formed of the tamper evident ring 4.5, which remains fastened to the main body 3 held by the fastening elements 3.11, thereby providing evidence of opening and helping the end user to understand if the product/plug has been previously violated or even worse counterfeited.

The invention claimed is:

1. A delivering tap for delivering liquids from a container comprising:

a main body comprising a connecting element having fitting means with the container, and a supporting body adapted to be closed by a plug cooperating with a cam seal separated from the supporting body, a rotation of the plug having a linear movement effect of the plug itself, the supporting body comprising a first opening for exiting liquid, and sealing means cooperating with the first opening and adapted to be connected to the plug, the supporting body further comprising external guiding means obtained on its external surface and adapted to guide the plug in the opening and closing steps of the plug cooperating with a cam profile;

the plug comprising a central cylinder having lower sealing means obtained at its lower end and adapted to be coupled with the sealing means of the main body to determine the seal of the plug next to the first opening;

wherein the cam profile is made of two parts, the first part of the cam profile being made on the plug and the second part of the cam profile being made on the cam seal, so that when the plug is rotated, the external guiding means, moving in the groove formed of the first part and of the second part of the cam profile, generate a linear movement of the plug.

2. The delivering tap of claim 1, wherein the cam seal cooperates with fastening elements obtained on the supporting body and further comprises a tamper evident ring connected to the cam seal through frangible elements adapted to be broken upon the first opening of the tap, so that the tamper evident ring remains fastened to the main body kept by the fastening elements to point out the opening of the tap.

3. The delivering tap of claim 1, wherein the plug comprises an upper part connected to the central cylinder, inside which the first part of the cam profile is made, and wherein the second part of the cam profile is made on a wall of the cam seal.

4. The delivering tap of claim 1, further comprising a sealing valve connected to the plug, comprising an external sealing surface connected with interference to an internal surface of the supporting body.

5. The delivering tap of claim 4, wherein the valve comprises flexible upper and lower sealing lips adapted to be operatively coupled with upper sealing means of the plug composed of an area of the central cylinder with increased diameter.

6. The delivering tap of claim 1, wherein the plug comprises a threading made therein which operates as upper abutment of the external guiding means of the main body and is the edge of the first part of the cam profile, while the second part of the cam profile is made on the upper edge of a cylindrical wall of the cam seal.

7. The delivering tap of claim 1, wherein the main body comprises fastening elements, connected to abutment ribs and to abutment elements of the seal obtained on the external surface of the supporting body, for assembling the cam seal.

8. The delivering tap of claim 1, wherein the plug cooperates with the cam seal by means of projecting elements present on the cam seal which cooperate with seats made inside the upper part of the plug.

9. The delivering tap of claim 8, wherein the cam seal comprises projecting elements obtained on its external surface adapted to be fastened to the seats of the plug and abutments adapted to transmit the rotary motion of the plug to the cam seal once assembled.

10. The delivering tap of claim 1, wherein the cam seal comprises a flat profile at the end of the second part of the cam profile on which the external guiding means reside during the closing step of the tap to prevent an accidental opening of the plug, and comprises a bearing of the external guiding means which limits its excursion during the closing step of the plug.

* * * * *